US007503534B2

(12) United States Patent
Pollack

(10) Patent No.: US 7,503,534 B2
(45) Date of Patent: Mar. 17, 2009

(54) UNIVERSAL BATHROOM ACCESSORY SYSTEM

(76) Inventor: Robert W. Pollack, 55 Dunbow Dr., Chappaqua, NY (US) 10514

( * ) Notice: Subject to any disclaimer, the term of this patent is extended or adjusted under 35 U.S.C. 154(b) by 124 days.

(21) Appl. No.: 11/348,181

(22) Filed: Feb. 6, 2006

(65) Prior Publication Data

US 2006/0180722 A1 Aug. 17, 2006

Related U.S. Application Data

(60) Provisional application No. 60/650,203, filed on Feb. 4, 2005.

(51) Int. Cl.
*F16M 11/00* (2006.01)

(52) U.S. Cl. ..... 248/201; 248/205.3; 248/251; 248/309.1; 211/88.04; 211/105.1

(58) Field of Classification Search ..... 248/201, 248/200.1, 235, 241, 244, 248, 250, 222.1, 248/221.11, 309.1, 309.2, 205.3, 251; 211/105.1, 211/123, 88.04; 242/55.3
See application file for complete search history.

(56) References Cited

U.S. PATENT DOCUMENTS 1,893,729 A * 1/1933 Call ..... 248/222.14
4,205,802 A * 6/1980 Economakis ..... 242/594.5
4,662,593 A * 5/1987 Shames et al. ..... 248/222.14
4,671,419 A * 6/1987 Beverly ..... 211/105.1
4,981,276 A * 1/1991 Agor et al. ..... 248/222.14
5,464,170 A * 11/1995 Mitchell et al. ..... 242/598
5,718,404 A * 2/1998 Greer ..... 248/309.2
6,131,213 A * 10/2000 Sarff ..... 4/576.1
6,257,425 B1 * 7/2001 Liu ..... 211/90.01
6,651,830 B2 * 11/2003 Pan ..... 211/105.1
6,896,228 B1 * 5/2005 Lu ..... 248/205.8
2006/0168720 A1 * 8/2006 Dellarocca ..... 4/559

* cited by examiner

*Primary Examiner*—Amy J. Sterling
(74) *Attorney, Agent, or Firm*—Edwards Angell Palmer & Dodge LLP

(57) ABSTRACT

A "Universal Unit" is disclosed, for use singly or in pairs, to form a bathroom accessory system. The Universal Unit has a back portion with a substantially flat front surface and a rear surface which is adapted for mounting on a wall. The Universal Unit has an upstanding projecting portion extending perpendicularly outward from the front surface. This projecting portion has two lateral and substantially parallel sides with at least one recess in one side for holding a separate accessory. The recess may be round, in which case the accessory may be a toilet tissue spindle, a towel bar or a grab bar, or it may be elongate in which case the accessory may be a shelf, a soap dish, a tumbler holder and/or toothbrush holder. Advantageously, the projecting portion has two recesses, one round and one elongate, so that a single Universal Unit may be manufactured, warehoused, sold and used for all of the above-mentioned purposes. The projecting portion and the back portion may be separate pieces.

24 Claims, 7 Drawing Sheets

B

UNIVERSAL BATHROOM ACCESSORY SYSTEM

CROSS REFERENCE TO RELATED APPLICATION

This present application claims benefit of priority from U.S. Provisional Application Ser. No. 60/650,203, filed Feb. 4, 2005, entitled "UNIVERSAL BATHROOM ACCESSORY SYSTEM".

BACKGROUND OF THE INVENTION

The present invention relates to a bathroom accessory system, comprised of a ceramic, plastic, composite, or metal object ("Universal Unit") which, when used singly or in pairs, along with adapter pieces, such as toilet tissue spindles or soap dish adapters, creates most of the common wall-mounted bathroom accessories. The preferred embodiment is of ceramic material of the same color and finish as the ceramic tile surrounding it, to give a homogeneous aesthetic appearance. The adapter pieces could be made of ceramic to match the tile, or more likely of plastic, metal or a composite material.

Existing bathroom accessories are either ceramic elements that match the color and finish of specific ceramic wall tile or the "surrounds" with which these accessories are meant to be used, or they are stand-alone elements on wallboard or plaster surfaces. In the latter case, they may be made of ceramic metal, perhaps with architectural metal finishes, plastic or composites of different materials.

In recent years, because of the difficulty of stocking ceramic bathroom accessories in all of the colors and finishes available in bathroom tile that is sold, the fashion of having matching accessories has become less possible. Metal, ceramic, and plastic or composite bathroom accessories are available in hardware and home furnishing stores. Very few are bought through tile suppliers with matching tile any more. Of the ceramic tile manufacturers who still distribute ceramic accessories, only a few types of accessories are offered, usually a soap dish and toilet tissue holder and usually only in a white color. Some of the accessories attach with tile setting grout or adhesive. Other accessories attach with screws or proprietary clips. There are also accessories that do not mount to walls but sit on horizontal surfaces in the bathroom.

SUMMARY OF THE INVENTION

A principal objective of the present invention is to provide a Universal Bathroom Accessory System which minimizes the number of different objects or elements which must be manufactured and stored in local warehouses for sale to the building trade.

This objective, as well as further objectives which will become apparent from the discussion that follows, are achieved, in accordance with the present invention, by providing a so-called "Universal Unit", for use singly or in pairs in a bathroom accessory system. The Universal Unit has a back portion with a substantially flat front surface and a rear surface which is adapted for mounting on a wall. The Universal Unit has an upstanding projecting portion extending perpendicularly outward from the front surface. This projecting portion has two lateral and substantially parallel sides with at least one recess in one side for holding a separate accessory. The recess may be round, in which case the accessory may be a toilet tissue spindle, a towel bar or a grab bar, or it may be elongate in which case the accessory may be a shelf, a soap dish, a tumbler holder and/or toothbrush holder.

Preferably, the back portion of the Universal Unit is square shaped and has the dimensions of a standard ceramic tile. Indeed, at least the back portion is preferably made of ceramic and the front surface thereof has a glazed tile finish designed to match a complete set of square tiles.

Preferably, both the back portion and the projecting portion are integral and made of the same ceramic material.

In a preferred embodiment, therefore, the front surface of the back portion has four edges of substantially equal length and the lateral sides of the projecting portion extend substantially parallel to one of the edges. Preferably also, the projecting portion is off-set from the center of the back portion so that two Universal Units may be conveniently packed together in a common box with, the projecting portion of one facing the back portion of the other. The projecting portions are off-set sufficiently to permit a toilet tissue row to fit between them when used in pairs.

Preferably also, where the one lateral side of the projecting portion has two recesses, one round and the other elongate in shape, the elongate recess extends perpendicular to the front surface of the back portion in direct alignment with the round recess.

The Universal Unit may be made of any suitable material, such as ceramic, plastic, metal or a composite of different materials.

One or more Universal Units may be mounted on a wall either individually or as a pair in spaced relationship to each other.

The rear surface of the back portion of the Universal Unit may be serrated to form lugs and cavities for improved adhesion when it is mounted on a wall. For added strength in mounting, the back portion of the Universal Unit may have one or two openings extending through the back portion into the projecting portion to receive one or more attachment devices such as reinforcement studs or the like.

For added safety and decorative purposes, the front edge of the projecting portion may be rounded.

For a full understanding of the present invention, reference should now be made to the following detailed description of the preferred embodiments of the invention as illustrated in the accompanying drawings.

BRIEF DESCRIPTION OF THE DRAWINGS

FIG. 21 illustrates a side view; FIG. 22 illustrates a section view showing how the insertion of grout locks the projecting portion to the back portion and FIG. 23 illustrates a front view.

DESCRIPTION OF THE PREFERRED EMBODIMENTS

Figure 1:
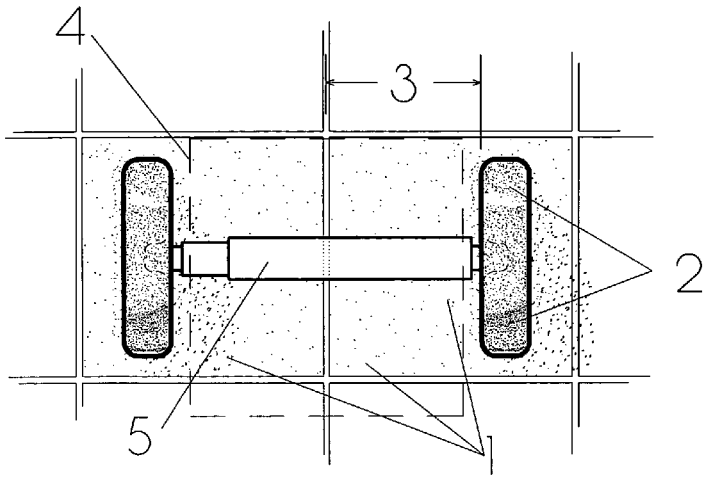
FIG. 1 is a front elevational view of a pair of Universal Units according to the present invention, mounted on a vertical tile wall, the projecting portions used in a vertical position, with a toilet tissue roll extending between them.

The preferred embodiments of the present invention will now be described with reference to FIGS. 1-23 of the drawings. Identical elements in the various figures are designated with the same reference numerals.

FIGS. 1 through 7 and 15 through 20 illustrate the Universal Unit along with formed adapter pieces which make up the system according to the present invention. Using single Universal Units or in pairs, in concert with adapter pieces, most of the popular bathroom accessories can be created. These figures illustrate a toilet tissue holder, a soap holder/grab bar, a small soap dish and matching tumbler/toothbrush holder, towel bar and shelf unit. All add-on adapter pieces are designed to snap out for cleaning. The decor could be changed by replacing the adapter pieces with different motifs. The adapter pieces can have a metallized finish, be of transparent or opaque plastic, ceramic, glass or composites. In the preferred embodiment of the invention, the adapter pieces are made of clear or smoked acrylic plastic.

Because the projecting portion is off-set from the centerline, two Universal Units can be nested and, if based on a 4×4 tile, could fit into a box approximately 4.5"×4.5" for compact storage and stocking if based on a 4×4 tile. The projecting portion's location is determined by the dimensions of a standard roll of toilet tissue. Installed in a tile wall other than one based on a 4"×4" tile might require the use of one or more sizes of adapter tiles.

FIGS. 8 through FIG. 14 illustrate a system which enables the ceramic accessories to be used in bathrooms where little or no wall tile is used, such as gypsum board or plaster surfaces. FIGS. 8 through 14 illustrate possible design schemes using shaped tiles with finish edges (bullnose, ogee, or other shapes.) Quarter circle tile and straight tiles with bullnose or other decorating outer edges create various "surround" shapes.

A problem with hanging damp towels against a gypsum board or plaster surface is the fact that these surfaces will absorb moisture which will blister the paint and often promote mildew or mold growth. A surround of ceramic tile would be a functional improvement over the current situation in most homes. Wall surfaces surrounding most bathroom accessories receive more abrasion abuse than other wall areas. All such locations could benefit from having a durable, ceramic tile surround.

Attachment of the Universal Unit to a tile substrate would, in most cases, be by the same method as used for attaching the tile. If greater pull-out strength is required for a towel bar or grab bar, or for higher abuse areas such as public restrooms or showers, a stud system could be employed, where a template is provided to aid the installer in locating the installation of a rustproof metal stud(s). The stud(s) would project almost the full length of the cavity inside the Universal Unit. It would have anular "harpoon" rings and a hex head to facilitate installation with a socket wrench into a stud or specially reinforced blocking behind the gypsum board. The cavity in the Universal Unit would be filled with a curing type cementitious or synthetic high strength grout of putty consistency and the unit inserted over the stud and into the tile setting bed.

FIG. 1 illustrates a toilet tissue holder accessory which is comprised of two "Universal Units" and a spring-loaded spindle. Reference #1 points to the back portion of the Universal Unit which is dimensionally the same as a standard 4"×4" tile, or has other standard tile dimensions. #2 points to the projecting portion of the Universal Unit which is employed in the vertical position. #3 is the dimension determining the off-set of the projecting portion to accommodate a toilet tissue roll. #4 is a dashed rectangle indicating the toilet tissue roll. #5 indicates the spring-loaded spindle.

Figure 2:
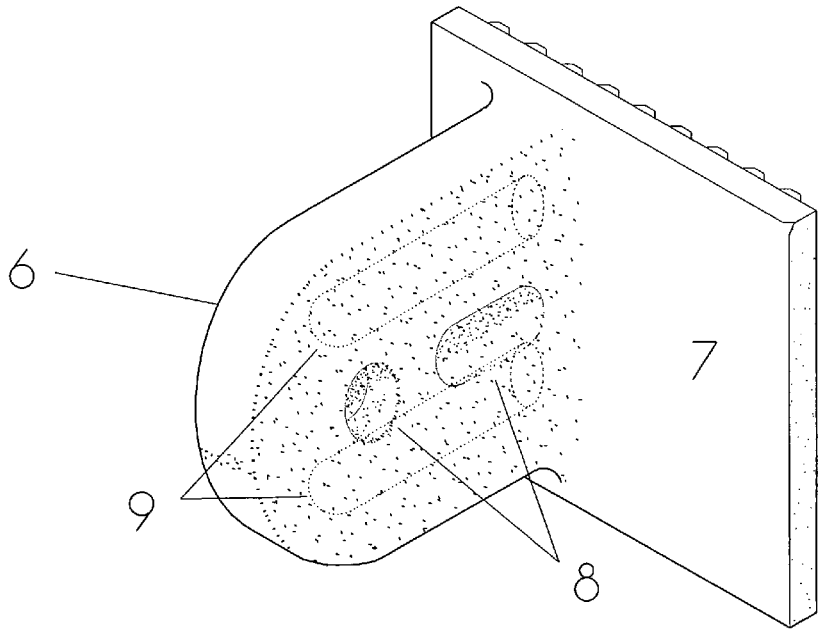
FIG. 2 is an isometric view of the preferred embodiment of the Universal Unit according to the present invention.

FIG. 2 is a perspective view of a Universal Unit. Reference #6 indicates the projecting portion of the Universal Unit. #7 is the back portion of the Universal Unit. #8 points to recesses in the side of the Universal Unit to receive a toilet tissue roll spindle or protrusions of other bathroom accessory adapter pieces. One recess 8A is round, while the other recess 8B may be elongate in shape, arranged perpendicular to the back portion and in alignment with the round recess. #9 indicates two hollow openings within the projecting portion for insertion over reinforcement studs.

Figure 3:
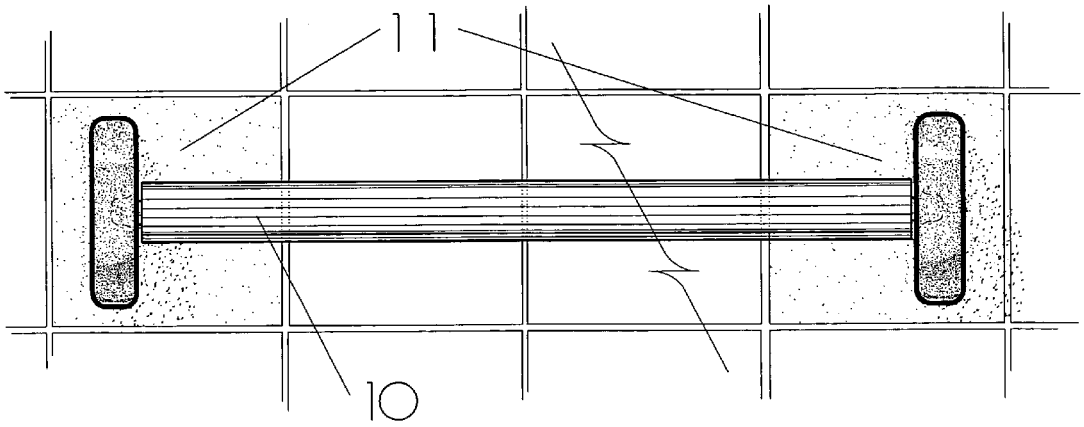
FIG. 3 is a front elevational view of a pair of Universal Units with the projecting portions used in a vertical position, with a towel bar extending between them.

FIG. 3 illustrates a towel bar accessory with the projecting parts used in the vertical position. Reference #10 indicates the towel bar tube which may be of plastic, metal or composite. Its length will vary incrementally in stages equal to a tile module. #11 points to fittings at each end of the bar that secure into the round recesses of the Universal Unit projecting portion.

Figure 4:
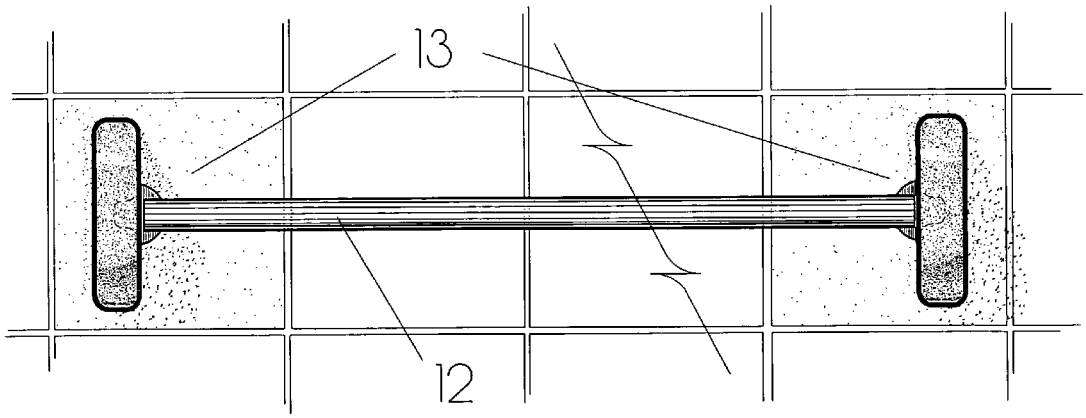
FIG. 4 is a front elevational view of a pair of Universal Units with the projecting portions used in a vertical position with a shelf extending between them.

FIG. 4 illustrates a Shelf accessory where the projecting parts are used in the vertical position. Reference #12 points to the shelf ideally made of tempered safety glass or other glass, plastic, ceramic, metal or composite material. The shelf length will vary incrementally in stages equal to the tile module. #13 indicates the resilient fittings for securing the shelf. These fittings may be made ideally of clear silicone rubber, vinyl or other flexible material. Protrusions on the fittings exactly fit into the elongate recesses on the projecting portion of the Universal Unit and be locked in place by the shelf which is then inserted onto the snug grooves of the fittings.

Figure 5:
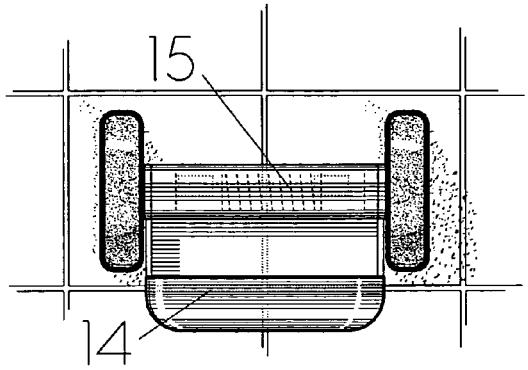
FIG. 5 is a front elevational view of a pair of Universal Units with the projecting portions used in a vertical position with a grab bar and soap dish extending between them.

FIG. 5 illustrates a large soap dish with grab bar as might be useful at a bathtub or in a shower stall. The projecting parts are used in the vertical position. The soap dish #14, is removable for washing in a sink by compressing two spring-loaded toggles. The grab bar must be more securely anchored to the wall than just the adhesion of the tile setting material, by employing anchoring studs embedded into the Universal Units' cavities with a curing grout.

Figure 6:
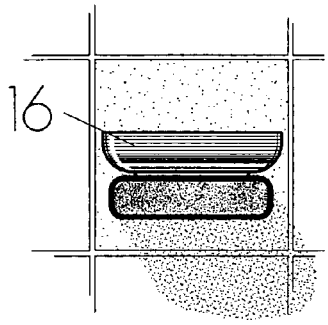
FIG. 6 is a front elevational view of a single Universal Unit with the projecting element used in a horizontal position with a soap dish accessory.

FIG. 6 illustrates a small soap dish as might be used flanking a lavatory mirror. In this accessory, the Universal Unit is used with its projecting portion in the horizontal position.

Reference #16 points to the soap dish adapter. A projection from the bottom of the soap dish adapter with an "O" ring or resilient sleeve provides a snug fit for the adapter into the round recess in the Universal Unit. The soap dish could also be provided with an elongate projection to fit into the elongate recess for added security.

Figure 7:
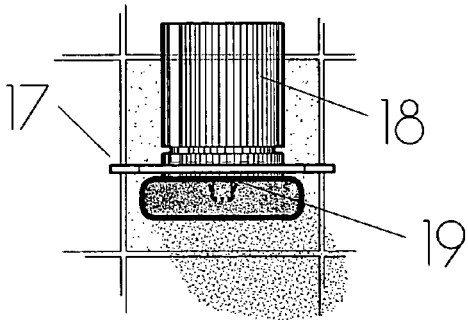
FIG. 7 is a front elevational view of a Universal Unit with the projecting element used in a horizontal position with a tumbler and toothbrush holder accessory.

FIG. 7 describes a toothbrush and tumbler holder as might be used flanking a lavatory mirror. The Universal Unit is used with the projecting portion arranged in the horizontal position. Reference #17 indicates the toothbrush/tumbler holder adapter piece which has a projecting part with "O" ring or resilient sleeve providing a snug fit for the adapter into the round recess #19 of the Universal Unit. #18 indicates the tumbler matching the motif of the holder. Again, the tumbler adapter may have a projection that fits into the elongate recess.

Figure 8:
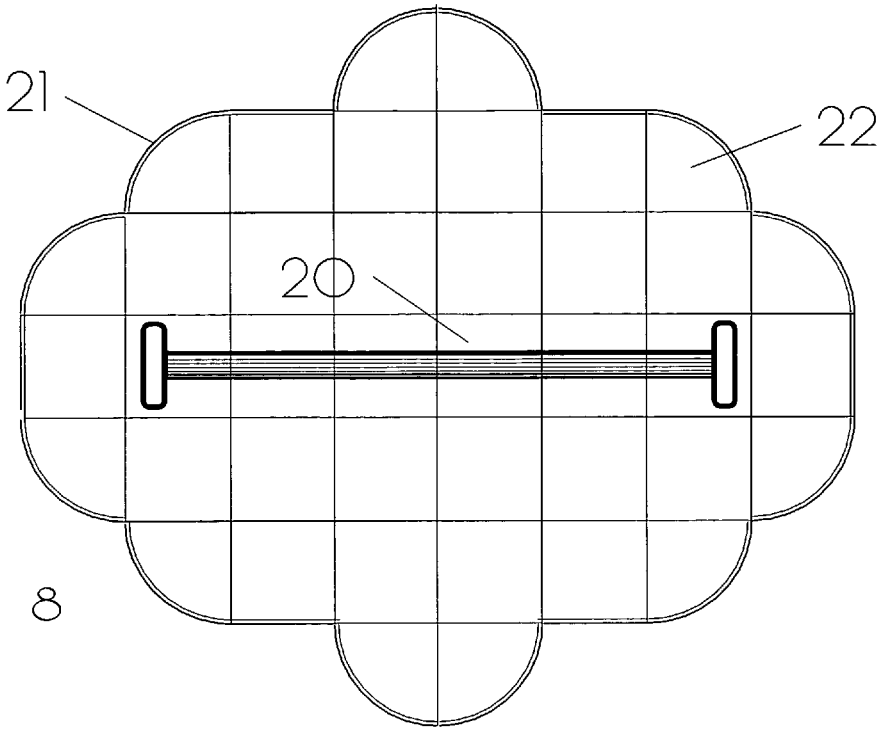
FIG. 8 is a front elevational view of a pair of Universal Units with a ceramic surround system.

FIG. 8 illustrates a ceramic tile surround system to provide a ceramic tile area on a sheetrock or plaster wall to work with and compliment bathroom accessories created by the Universal Unit Accessory system. Reference #20 indicates a towel bar or shelf accessory. #21 points to an outer tile edge with a bullnose finished edge or other formed decorative finished edge. #22 is a quarter round design tile with finished outer edges and raw cushion edged inner edges. Design tiles of other shapes could also be manufactured to expand the design pallet of the tile surrounds as well as for finishing tile wall areas such as at the top of tile wainscots.

Figure 9:
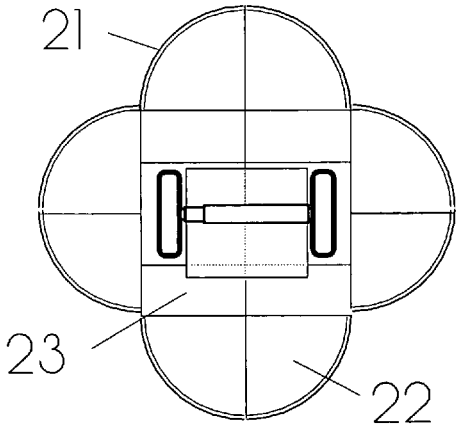
FIG. 9 is a front elevational view of a pair of Universal Units with a small ceramic surround system.

FIG. 9 illustrates a possible tile surround motif for a toilet tissue holder or soap dish/grab bar, where #21 points to a finished edge, #22 indicates a quarter round tile, and #23 points to a nominal 4"×2" adapter tile having all raw cushion edges.

Figure 10:
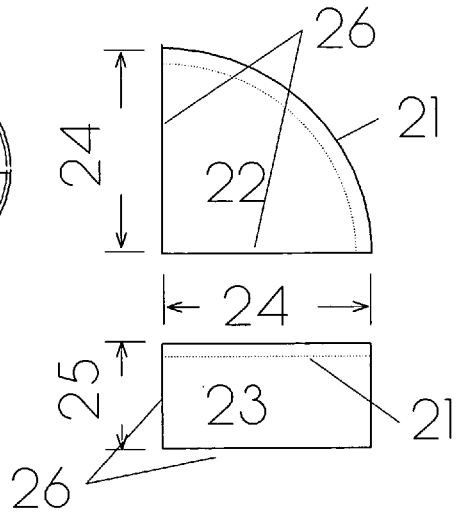
FIG. 10 is an isometric view of two tile shapes which are used in the surround system of FIG. 9.
Figure 11:
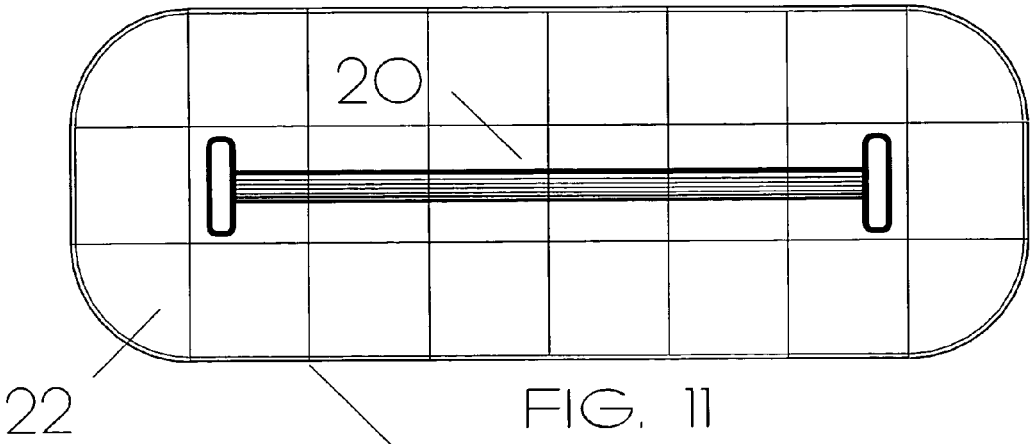
FIGS. 11-14 show the use of a Universal Unit in a ceramic tile surround system of various configurations, respectively.
Figure 12:
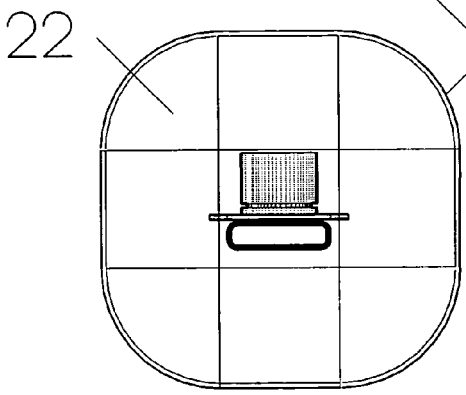
Figure 13:
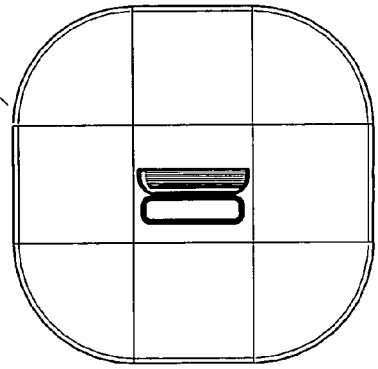
Figure 14:
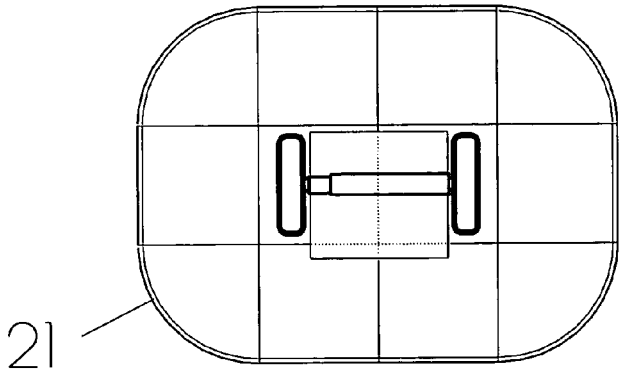

FIG. 10 shows two adapter tiles. Reference #21 indicates a bullnose or other finished edge. #22 is a quarter round tile. #23 is a half tile adapter tile. #24 is a 41" nominal or other standard tile dimension. #25 is a dimension that is half of a standard tile. #26 points to standard raw cushion edge which is the same as any standard tile edge.

FIGS. 11, 12, 13, and 14 illustrate a minimal tile surround design for a towel bar or shelf accessory, tumbler/toothbrush holder, small soap dish, and toilet tissue holder, respectively. The arrangement of FIG. 14 may also be used for a soap dish/grab bar accessory. In these figures, reference #20 points to a towel bar or shelf accessory, #21 indicates bullnose or other finished edges and #22 indicates a quarter round tile.

Figure 15:
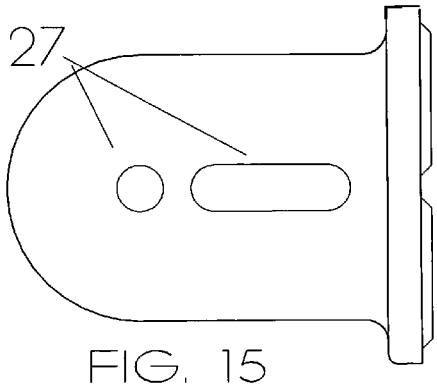
FIG. 15 is a side view of the Universal Unit of FIG. 2, showing the positions of the round and elongate recesses.

FIG. 15 is an inside side view of the Universal Unit. Reference #27 points to the recesses which accept the adapter pieces.

Figure 16:
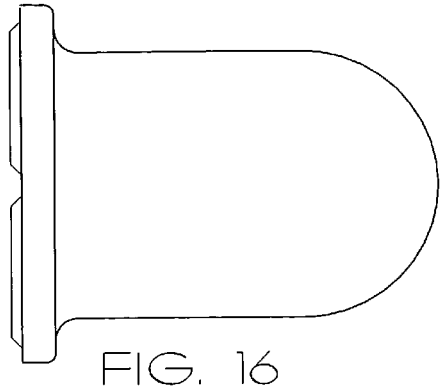
FIG. 16 is a side view of the Universal Unit, showing the side opposite to that of FIG. 15.

FIG. 16 is an outside side view of the Universal Unit.

Figure 17:
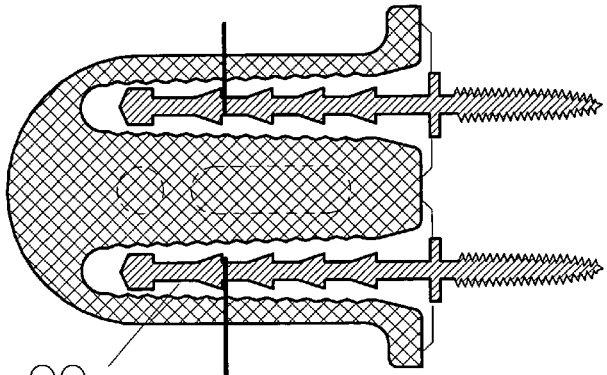
FIG. 17 is a cross-sectional view of the Universal Unit taken along line "B" in FIG. 20.

FIG. 17 is cross-sectional view through section "B" (from FIG. 20) cutting through the entire Universal Unit and optional reinforcement studs. #29 points to the reinforcing studs in the fixture cavity.

Figure 18:
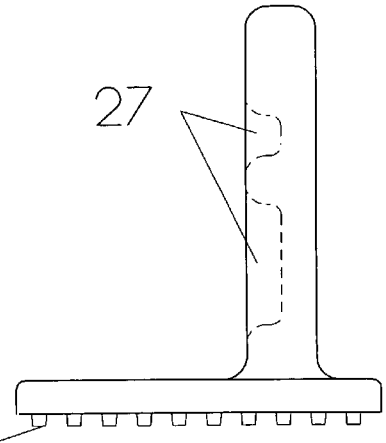
FIG. 18 is an edge view of the Universal Unit of FIG. 2.

FIG. 18 is an edge view of the Universal Unit. Reference #27 points to the round and elongate recesses, respectively, that accept the adapter pieces, shown in phantom (dashed lines). #28 points to the tile bottom lugs which will match the design of a standard tile-back lug pattern.

Figure 19:
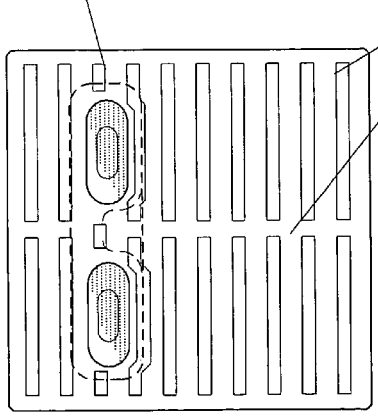
FIG. 19 is a rear view of the Universal Unit of FIG. 2.

FIG. 19 illustrates the back of the Universal Unit which faces the wall and is set into thinset mortar, synthetic mortar, cementitious thick setting bed (mud), or tile adhesive. #28 points to the lugs which are used to enhance adhesion to thinset and other mortar beds. #29 points to the cavity openings which exist to provide a more uniform clay mass for proper firing of the clay, and for additional anchorage reinforcement.

Figure 20:
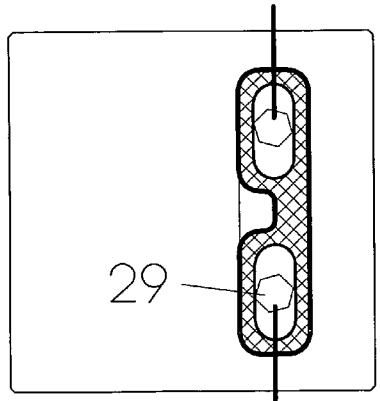
FIG. 20 is a cross-sectional view of the Universal Unit taken along the line "A" in FIG. 17.

FIG. 20 is a plan view and section "A" (from FIG. 17) through the projecting portion of the Universal Unit. #29 points to the cavities which can receive reinforcement studs embedded in curing type grout.

Figure 21:
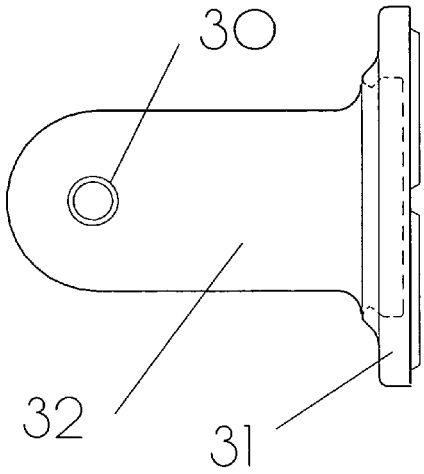
FIGS. 21 through 23 describe another preferred embodiment of the invention.
Figure 22:
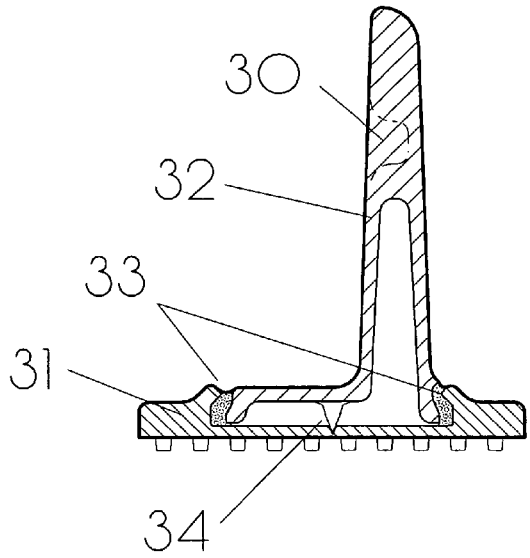
Figure 23:
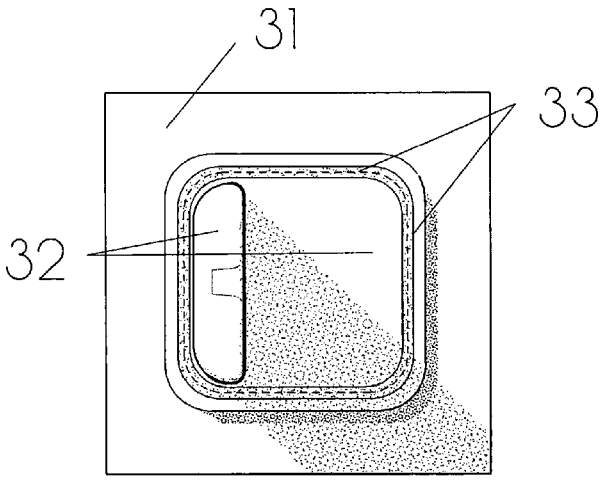

According to a particular preferred embodiment of the present invention, the Universal Unit in the ceramic tile accessory system utilizes a back portion of the same appearance as a standard wall tile, but has a recess similar in nature to a dove-tail socket, wherein separate "accessory adapters" are inserted into the recess and tile grout is forced into the joint between them thereby permanently locking the back portion to the accessory insert. This embodiment is shown in FIGS. 21-23.

As illustrated in these Figures, the recessed back portion 31, which is modular with the wall tile an is set with the wall tile, receives adapter pieces which project from the wall and create the specific accessories. The illustration shows a projecting portion which creates half of a toilet tissue roll holder or towel bar. The adapter piece, reference #32 is inserted into a "dove-tailed" recess in the back portion, #31 and tile grout is forced into the groove, #33 which locks the accessory piece into place. #30 indicates the recess in the adapter piece to receive the toilet paper roll spindle or towel bar end. The preferred material for the back portion is of ceramic with the glazed finish to match the wall tile, although it could be made of other materials such as plastic, metal or composition material. The specific accessory insert adapter 32 is preferably cast from ceramic to match or compliment the wall tile, or from metal, plastic or composites. #34 indicates a centering device to aid in installation of the adapter 32 into the back portion 31.

The Universal Unit and bathroom accessory system according to the present invention have a number of advantages:

1. The system can provide designers with a graceful line of accessories that will appear to be sculpted from the wall with no unnecessary protrusions.

2. Because there is only one kind of ceramic object that must be stocked in local warehouses, it is possible for manufacturers to furnish the accessories in the color and finish of the tile being used.

3. The non-symmetrical design of the Universal Unit allows two units to be stocked in a box 4½"×4½"×4½", which is more compact than current accessories storage requirements.

4. The simple shape of the Universal Unit will require a minimum of hand finishing prior to glazing.

5. The preferred embodiment of the Universal Unit as illustrated has a smooth appearance with no sharp edges to injure users.

6. The tile surround system provides a means to use the universal bathroom accessory system on walls that are otherwise untiled.

7. The tile surround system provides a more durable surface at accessory locations to prevent moisture damage to sheetrock or plaster walls as well as abrasion damage.

There has thus been shown and described a novel universal bathroom accessory system which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. A universal tile accessory system comprising:

a) a universal unit for use singly or in pairs, the universal unit having:

i) a back portion with a substantially flat front surface and a substantially flat rear surface adapted for mounting on a wall, wherein the back portion of the universal unit has dimensions of a standard ceramic tile, whereby when the universal unit is mounted, the back portion matches the dimensions of surrounding tile, wherein the back portion of the universal unit lies in the same plane as the back portion of surrounding tile; and ii) only one upstanding projecting portion extending substantially perpendicularly outward from the front surface, the projecting portion having two lateral and substantially parallel sides with at least one recess on one side for holding a separate accessory, wherein the at least one recess of the universal unit is adapted and configured to permit the exchange of a plurality of different types of accessories to permit the universal unit to be used to construct a plurality of different types of bathroom fixtures.

2. The universal tile accessory system of claim 1, wherein only one of the accessories is mounted in the Universal Unit at a given time.

3. The universal tile accessory system of claim 1, wherein the universal unit can accommodate accessories chosen from the group consisting of a toilet tissue spindle, a shelf, a grab bar and a towel bar when used in cooperation with a second universal unit to create different types of bathroom fixtures.

4. The universal tile accessory system of claim 1, wherein the Universal Unit consists essentially of a monolithic structure without moving parts.

5. The universal tile accessory system of claim 1, wherein the system further includes an accessory selected from the group consisting of a soap dish, a toothbrush holder and a tumbler holder, wherein the accessory is mounted into the recess in the Universal Unit to form a bathroom fixture when the projecting portion of the Universal Unit is oriented in a generally horizontal orientation, when mounted, and the recess projects in a generally vertical direction, when mounted.

6. The universal tile accessory system of claim 1, wherein the system further includes a second Universal Unit and an accessory selected from the group consisting of a toilet tissue spindle, a shelf, a grab bar, a towel bar and a soap dish in combination with a grab bar, wherein the accessory is mounted into the recess in each Universal Unit to form a bathroom fixture when the projecting portion of the Universal Unit is oriented in a generally vertical orientation when mounted and the recess projects in a generally horizontal direction when mounted.

7. The universal tile accessory system of claim 1, wherein the front surface of the back portion is generally rectangular in shape.

8. The universal tile accessory system of claim 7, wherein the front surface of the back portion is generally square in shape.

9. The universal tile accessory system of claim 1, wherein the back portion is generally rectangularly shaped and has the dimensions of a standard ceramic tile.

10. The universal tile accessory system of claim 1, wherein the one side has at least two recesses, a first recess being round and a second recess being elongate in shape and extending substantially perpendicular to the front surface of the back portion.

11. The universal tile accessory system of claim 10, wherein the first recess is substantially in alignment with the elongate second recess.

12. The universal tile accessory system of claim 1, wherein the Universal Unit is made of a material selected from the group consisting of ceramic, plastic, metal, and a composite of different materials.

13. The universal tile accessory system of claim 1, wherein the rear surface of the back portion of the universal unit is serrated to form lugs and depressions between the lugs for improved adhesion to a wall.

14. The universal tile accessory system of claim 1, wherein the rear surface of the back portion of the universal unit has at least one opening extending through the back portion into the projecting portion for receiving a reinforcement stud for anchoring the universal unit to an object.

15. The universal tile accessory system of claim 1, further comprising a ceramic tile surround system to complement the universal unit.

16. The universal tile accessory system of claim 1, wherein the back portion and the projecting portion are integral and are of the same material.

17. The universal tile accessory system of claim 1, wherein the back portion has a decorative edge on the front surface.

18. The universal tile accessory system of claim 1, wherein the back portion and the projecting portion are separate elements, the projecting portion being adapted to be inserted in the back portion.

19. The universal tile accessory system of claim 18, wherein the back portion includes a recess having a cross-section with a dovetail shape for receiving the projecting portion therein.

20. The universal tile accessory system of claim 1, wherein the universal unit is adapted and configured to be used to support at least three different accessories chosen from the group consisting of a toilet tissue spindle, a shelf, a grab bar, a towel bar, a soap dish, a tumbler holder and a toothbrush holder when used in combination with the universal unit to form a bathroom fixture, wherein a selected accessory is supported by the recess.

21. The universal tile accessory system of claim 1, wherein the universal unit is adapted and configured to be used to support at least four different accessories chosen from the group consisting of a toilet tissue spindle, a shelf, a grab bar, a towel bar, a soap dish, a tumbler holder and a toothbrush holder when used in combination with the universal unit to form a bathroom fixture, wherein a selected accessory is supported by the recess.

22. The universal tile accessory system of claim 1, wherein the universal unit is adapted and configured to be substantially permanently mounted to a surface.

23. The universal tile accessory system of claim 1, wherein the front surface of the back portion of the universal unit is about four inches square.

24. The universal tile accessory system of claim 1, wherein the system further comprises a plurality of accessories selected from the group consisting of a toilet tissue spindle, a shelf, a grab bar, a towel bar, a soap dish, a toothbrush holder and a tumbler holder, wherein a plurality of different types of bathroom fixtures may be constructed by using the universal unit in combination with each of the accessories.

* * * * *